US009434600B2

(12) United States Patent
Yoo et al.

(10) Patent No.: US 9,434,600 B2
(45) Date of Patent: Sep. 6, 2016

(54) FLUID COLLECTING APPARATUS

(71) Applicant: NATIONAL DISASTER MANAGEMENT INSTITUTE, Seoul (KR)

(72) Inventors: Byungtae Yoo, Seoul (KR); Keumho Oh, Goyang-si (KR)

(73) Assignee: NATIONAL DISASTER MANAGEMENT INSTITUTE (KR)

( * ) Notice: Subject to any disclaimer, the term of this patent is extended or adjusted under 35 U.S.C. 154(b) by 0 days.

(21) Appl. No.: 14/630,633

(22) Filed: Feb. 24, 2015

(65) Prior Publication Data

US 2015/0246806 A1 Sep. 3, 2015

(30) Foreign Application Priority Data

Mar. 3, 2014 (KR) ..... 10-2014-0024908

(51) Int. Cl.
*B67D 7/32* (2010.01)

(52) U.S. Cl.
CPC ..... *B67D 7/3209* (2013.01); *F23N 2031/18* (2013.01); *Y10T 137/5762* (2015.04)

(58) Field of Classification Search
CPC ..... B67D 7/3209; F23N 2031/18; Y10T 137/5762; Y10T 137/5835
USPC ..... 137/312, 313
See application file for complete search history.

(56) References Cited

U.S. PATENT DOCUMENTS 5,511,573 A * 4/1996 Corte ..... F16K 27/12 137/15.08
6,935,161 B2 * 8/2005 Hutchinson ..... B67D 7/3209 73/40.5 R
7,832,367 B2 * 11/2010 Valentas et al. ..... B23M 11/00 122/506
8,851,099 B2 * 10/2014 DeGeorge et al. ..... B23P 11/00 137/15.11

FOREIGN PATENT DOCUMENTS

JP 2005201444 A 7/2005
JP 4943954 B2 3/2012

* cited by examiner

*Primary Examiner* — Kevin Lee

(57) ABSTRACT

Disclosed herein is a fluid collecting apparatus. The apparatus comprises a body disposed adjacent to fluid conveying or storing equipment to limit a moving path of fluid leaked from the equipment, a collector connected to the body to collect the leaked fluid, and a controller connected to the body to control an operation of the collector. The fluid collecting apparatus is capable of safely collecting fluid, for example, harmful gas leaked from fluid conveying or storing equipment.

7 Claims, 14 Drawing Sheets

FLUID COLLECTING APPARATUS

BACKGROUND OF THE INVENTION

1. Field of the Invention

The present invention relates to a fluid collecting apparatus.

2. Description of the Related Art

In an industrial site where equipment is installed to convey or store harmful gas, such as toxic gas or strong-acid gas, safety measures are taken to prevent the leakage of the harmful gas. However, harmful-gas leakage accidents frequently occur because of the corrosion of the equipment resulting from its lengthy use, an inadequate safety testing, or a worker's mistakes when a device, such as a pipe or a valve, is replaced with another one. The leakage of the harmful gas leads to loss of lives. Additionally, environmental damages occur over a widespread area because the harmful gas is rapidly diffused, thus causing huge losses.

In order to prevent damages due to the harmful gas exposure, research into technology for detecting the leakage of the harmful gas is being made. However, research into technology for collecting leaked harmful gas and preventing the diffusion of the leaked harmful gas is very insufficient.

SUMMARY OF THE INVENTION

Accordingly, the present invention has been made keeping in mind the above problems occurring in the related art, and the present invention is intended to propose a fluid collecting apparatus, which is capable of safely collecting fluid, for example, leaked harmful gas.

Other objects of the present invention will be apparent to those skilled in the art from the reading of the following description with reference to the accompanying drawings.

In order to achieve the above object, according to one aspect of the present invention, there is provided a fluid collecting apparatus, comprising a body disposed adjacent to fluid conveying or storing equipment to limit a moving path of fluid leaked from the equipment; a collector connected to the body to collect the leaked fluid; and a controller connected to the body to control an operation of the collector.

The body may have a first interior space surrounding an area of the equipment from which the fluid may be potentially leaked, and the collector may include a collecting bag having a second interior space that communicates with the first interior space, and disposed on the moving path of the leaked fluid; and an auxiliary bag connected to the collecting bag and having a third interior space separated from the second interior space.

The fluid collecting apparatus may further include an auxiliary-bag propeller disposed adjacent to the auxiliary bag, the auxiliary-bag propeller giving a propulsive pressure to the third interior space in response to a control signal of the controller, thus expanding the auxiliary bag, whereby the collecting bag may be expanded by expansion of the auxiliary bag.

The collecting bag may include a fluid outlet to discharge the leaked fluid.

The collector may include a collecting screen disposed above the body, and a plurality of collecting-screen support weights connected to an end of the collecting screen, wherein each of the collecting-screen support weights may be flied up in response to the control signal of the controller, thus causing the collecting screen to surround a peripheral area of the body.

The fluid collecting apparatus may further include a fluid detector disposed on the moving path of the leaked fluid in the body, thus detecting the leaked fluid, wherein the fluid detector may detect the leaked fluid and then transmit a detection signal to the controller.

The fluid collecting apparatus may further include a collector actuating switch disposed on an outer surface of the body, wherein, as the collector actuating switch may be pressed down, a collector actuating signal may be transmitted to the controller, and thereby the controller may actuate the collector.

The body may include a fluid outlet to discharge the leaked fluid to an outside.

The controller may communicate wirelessly with an exterior remote control room.

As is apparent from the above description, the fluid collecting apparatus is advantageous in that it can safely collect the harmful gas leaked out from harmful fluid conveying and storing equipment. Thereby, it is possible to prevent the loss of lives and the environmental damages that may occur due to the leakage of the harmful fluid. Further, the fluid collecting apparatus allows for easy installation and various operations and types of control such as an automatic control, a manual control, or a remote control; so that the apparatus may be used in various environments along with a variety of equipment. Moreover, the fluid collecting apparatus is connected to the fluid recovery device, thus safely collecting and recovering any continuously leaked harmful fluid.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

Figure 1A:
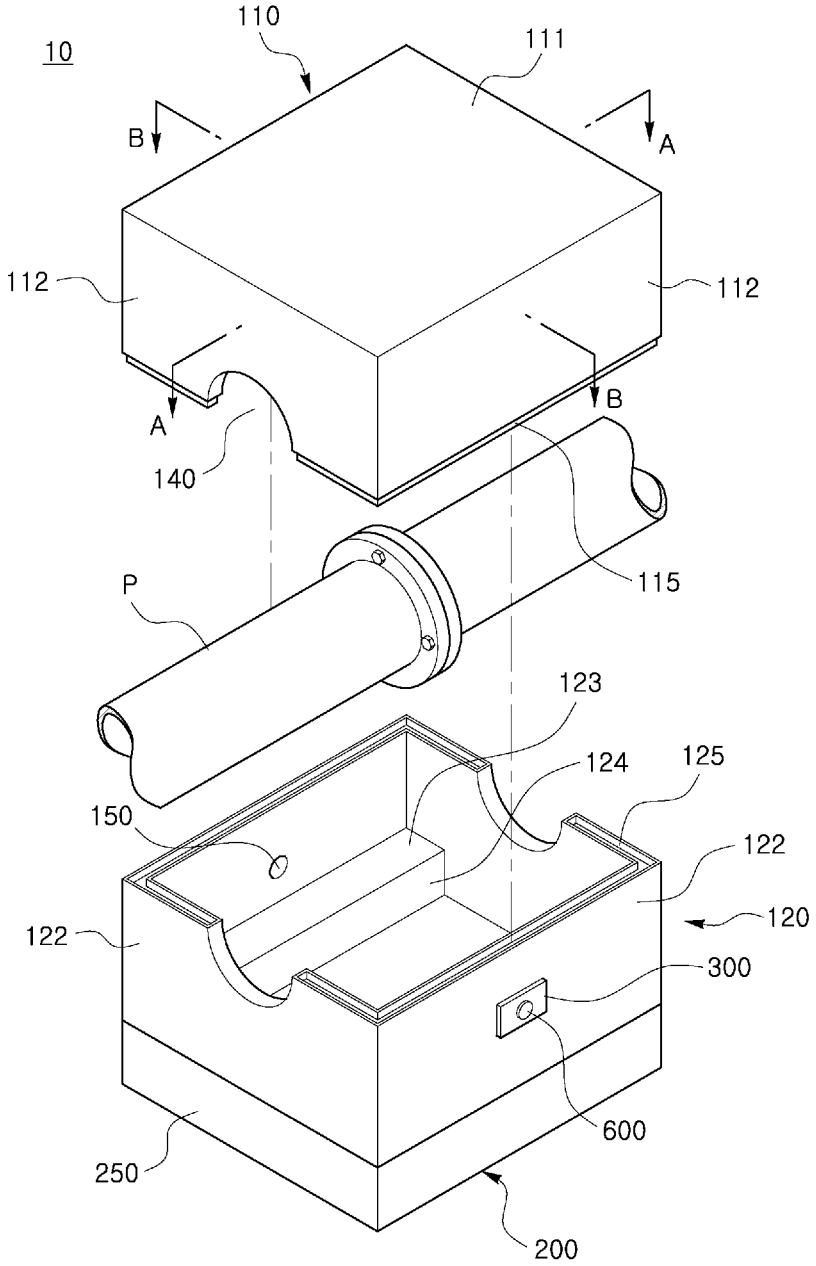
FIG. 1A is an exploded perspective view showing a fluid collecting apparatus according to an embodiment of the present invention.

Hereinafter, the present invention will be described in detail with reference to embodiments. The above and other objects, features, and advantages of the present invention will be apparent from a reading of the following embodiments. The present invention is not limited to embodiments described herein, but may be embodied in various forms. While preferred embodiments are described herein, it is to be understood that they merely make the invention more thorough and complete and aid in completely understanding those skilled in the art. Therefore, the invention should not be limited to the following embodiments.

For clarity and convenience of description, the size of components shown in the drawings may not be illustrated to scale. Further, the shape of components shown in the drawings may be somewhat changed if necessary. Therefore, it should be understood that the invention is not limited to the embodiments taken in conjunction with the accompanying drawings unless otherwise specifically stated, and that changes and variations may be made without departing from the spirit or scope of the claims.

Figure 1B:
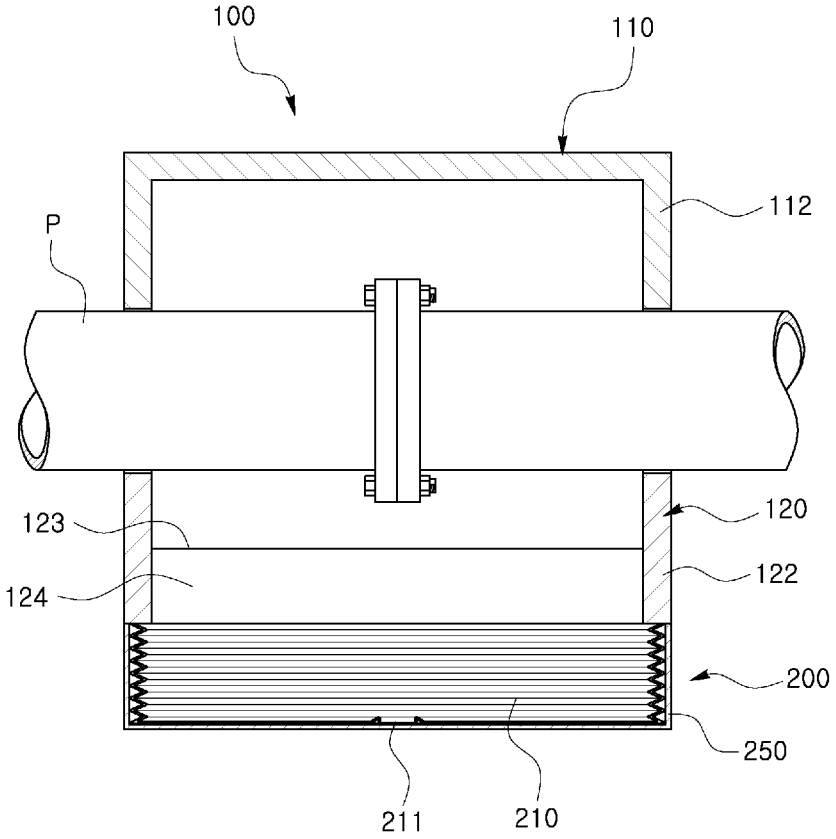
FIG. 1B is a sectional view taken along line A-A of FIG. 1A.
Figure 1C:
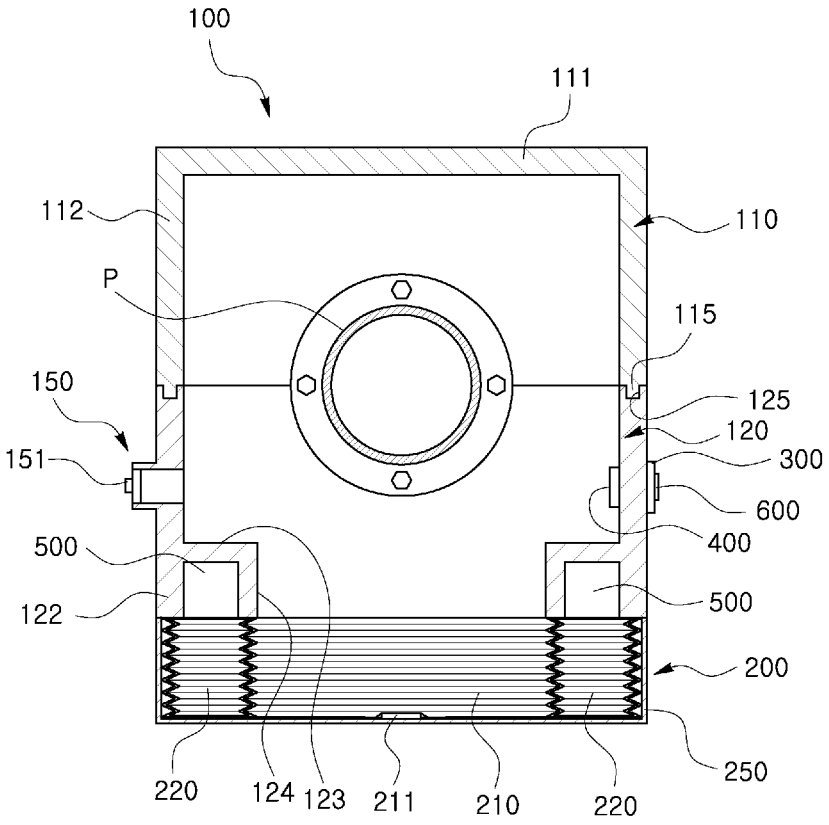
FIG. 1C is a sectional view taken along line B-B of FIG. 1A.

FIG. 1A is an exploded perspective view showing a fluid collecting apparatus according to an embodiment of the present invention, FIG. 1B is a sectional view taken along line A-A of FIG. 1A, and FIG. 1C is a sectional view taken along line B-B of FIG. 1A.

Referring to FIGS. 1A to 1C, the fluid collecting apparatus 10 may include a body 100, a collector 200, a controller 300, a fluid detector 400, an auxiliary-bag propeller 500, and an auxiliary-bag actuating switch 600.

The body 100 may be shaped to surround an area from which fluid, such as toxic gas or strong-acid gas, may be potentially leaked, for example, a pipe P for conveying the fluid or a junction of pipes P. Further, the body 100 may limit the moving path of the fluid leaked from the pipe P.

The body 100 may include a first body portion 110 and a second body portion 120.

The first body portion 110 may include a rectangular plate 111 and four first sidewalls 112 extending downwards from edges of the plate 111. Each first sidewall 112 may have a protrusion 115 that extends along a lower surface thereof.

The second body portion 120 may include four second sidewalls 122 corresponding to the first sidewalls 112, a first inner wall 123, and a second inner wall 124. The first inner wall 123 may be formed to extend from an inner surface of the second sidewall 122, through which the pipe P does not pass, towards an interior space, and the second inner wall 124 may be formed to extend downwards from an end of the first inner wall 123 in such a way as to be parallel to the second sidewall 122. According to this embodiment, two first inner walls 123 and two second inner walls 124 are provided, respectively. However, one first inner wall and one second inner wall may be provided, unlike this embodiment. The second body portion 120 may have a groove 125 that is formed along an upper surface thereof. The protrusion 115 of the first body portion 110 may be inserted into the groove 125 of the second body portion 120. By the insertion of the protrusion 115 into the groove 125, the first body portion 110 may be combined with the second body portion 120. Further, the insertion of the protrusion 115 into the groove 125 may prevent fluid escaping from the pipe from being leaked out through a gap between the first and second body portions 110 and 120.

The second body portion 120 may have a fluid outlet 150 that is formed in an associated sidewall 122. An outlet plug 151 may be fastened to an outside of the fluid outlet 150, thus isolating the interior space of the body 100 from the outside.

The body 100 may have through holes 140 on two sidewalls thereof through which the pipe P passes. Each through hole 140 may be defined by a portion of a lower surface of a first sidewall 112, which is formed to be concave upwards, and by a portion of an upper surface of a second sidewall 122, which is formed to be concave downwards. In order to prevent fluid escaping from the pipe P from being leaked to the outside through the through hole 140, a gap between a wall surface defining the through hole 140 and an outer surface of the pipe P may be sealed by Teflon, silicone or the like.

The first body portion 110 and the second body portion 120 may be coupled to each other by a coupling device (not shown), such as a hinge or a bolt fastening device, which is mounted to the outer surfaces of the sidewalls 112 and 122.

The collector 200 may be disposed under the first body portion 110 to be connected to the first body portion 110, and may include a collecting bag 210, a propelling bag 220, and a protective cover 250.

The collecting bag 210 may be disposed under the body 100 in such a way as to be folded. An upper edge of the collecting bag 210 may be connected to the lower surface of the second inner wall 124 of the second body portion 120 to allow the interior space of the body 100 to communicate with the interior space of the collecting bag 210. Further, the second inner wall 124 may serve to guide the fluid escaping from the pipe P into the collecting bag 210. The collecting bag 210 may be made of a material, for example, super fiber such as aramid fiber, which is resistant to fluid such as toxic gas or strong-acid gas. The collecting bag 210 may have on a lower end thereof a fluid outlet 211. An outlet plug (not shown) may be fastened to the fluid outlet 211 to isolate the interior space of the collecting bag 210 from the outside.

The auxiliary bag 220 may be disposed on either side of the collecting bag 210 underneath an area defined by the second sidewall 122, the first inner wall 123, and the second inner wall 124 in such a way as to be folded. One edge of an upper portion of the auxiliary bag 220 is connected to the lower surface of the second inner wall 124 along with the upper edge of the collecting bag 210, while the other edge of the upper portion of the auxiliary bag 220 is connected to the lower surface of the second sidewall 122. The auxiliary bag 220 and the collecting bag 210 may share one side surface, or a side surface of the auxiliary bag 220 may be attached to a side surface of the collecting bag 210. Thereby, the interior space of the auxiliary bag 220 and the interior space of the collecting bag 210 may not communicate with each other but may be separated from each other. Further, since the auxiliary bag 220 and the collecting bag 210 share the side surface or the side surfaces thereof are attached to each other, they may be folded in a similar form. According to this embodiment, the auxiliary bag 220 is disposed on either side of the collecting bag 210. However, without being limited to this embodiment, the auxiliary bag 220 may be disposed on only one side of the collecting bag 210.

The protective cover 250 may be disposed underneath the body 100 to surround the collecting bag 210 and the auxiliary bag 220. The edge of the protective cover 250 may be connected to the lower portion of the second sidewall 122. At normal times, the protective cover 250 serves to protect the collecting bag 210 and the auxiliary bag 220 from the outside. Meanwhile, in the event of fluid leakage, the protective cover 250 may be separated from the body 100 or may be ruptured by the propulsive pressure of the auxiliary bag 220.

The controller 300 may be disposed on the outer surface of the body 100 to control components of the fluid collecting apparatus 10. The controller 300 may be electrically connected to the fluid detector 400 and the auxiliary-bag propeller 500 by an electric wire located in the sidewall of the body 100, and may communicate with the exterior remote control room via wireless communication. The controller 300 may receive a detection signal from the fluid detector 400 and then transmit a control signal to the auxiliary-bag propeller 500. Further, the controller 300 may receive an auxiliary-bag actuating signal generated when the auxiliary-bag actuating switch 600 is pressed or may receive an auxiliary-bag actuating signal from the exterior remote control room and then may transmit a control signal to the auxiliary-bag propeller 500. Further, the controller 300 may provide the detection signal, received from the fluid detector 400, to the exterior remote control room. The remote control room receiving the detection signal may transmit the auxiliary-bag actuating signal to the controller 300.

The fluid detector 400 may be disposed on the inner wall of the body 100 to detect the fluid leaked from the pipe P. If the fluid detector 400 detects the leakage of the fluid, it may transmit the detection signal to the controller 300.

The auxiliary-bag propeller 500 may be located in an area defined by the second sidewall 122, the first inner wall 123, and the second inner wall 124. The auxiliary-bag propeller 500 may receive the control signal from the controller 300 and then provide the propulsive pressure to the auxiliary bag 220. The auxiliary-bag propeller 500 may be configured as a device including igniting powder that is ignited in response to the control signal (electric signal) of the controller 300 and propelling charge that is exploded by the ignition of the igniting powder to provide the propulsive pressure to the auxiliary bag 220. Alternatively, the auxiliary-bag propeller 500 may be configured as a device that stores compressed gas and sends the compressed gas to the auxiliary bag 220 in response to the control signal of the controller 300, thus providing the propulsive pressure.

The auxiliary-bag actuating switch 600 may be disposed on the controller 300. If the fluid leaked from the pipe P is detected and the auxiliary-bag actuating switch 600 is pressed from the outside, the auxiliary-bag actuating signal may be generated and transmitted to the controller 300. The controller 300 receiving the auxiliary-bag actuating signal may transmit the control signal to the auxiliary-bag propeller 500 to propel the auxiliary bag 220.

The fluid collecting apparatus 10 according to this embodiment is configured such that the collector 200 is located underneath the body 100. However, without being limited to this configuration, the collector may be rotated 90 or 180 degrees considering a position in which the pipe P is installed or its surroundings.

Figure 2A:
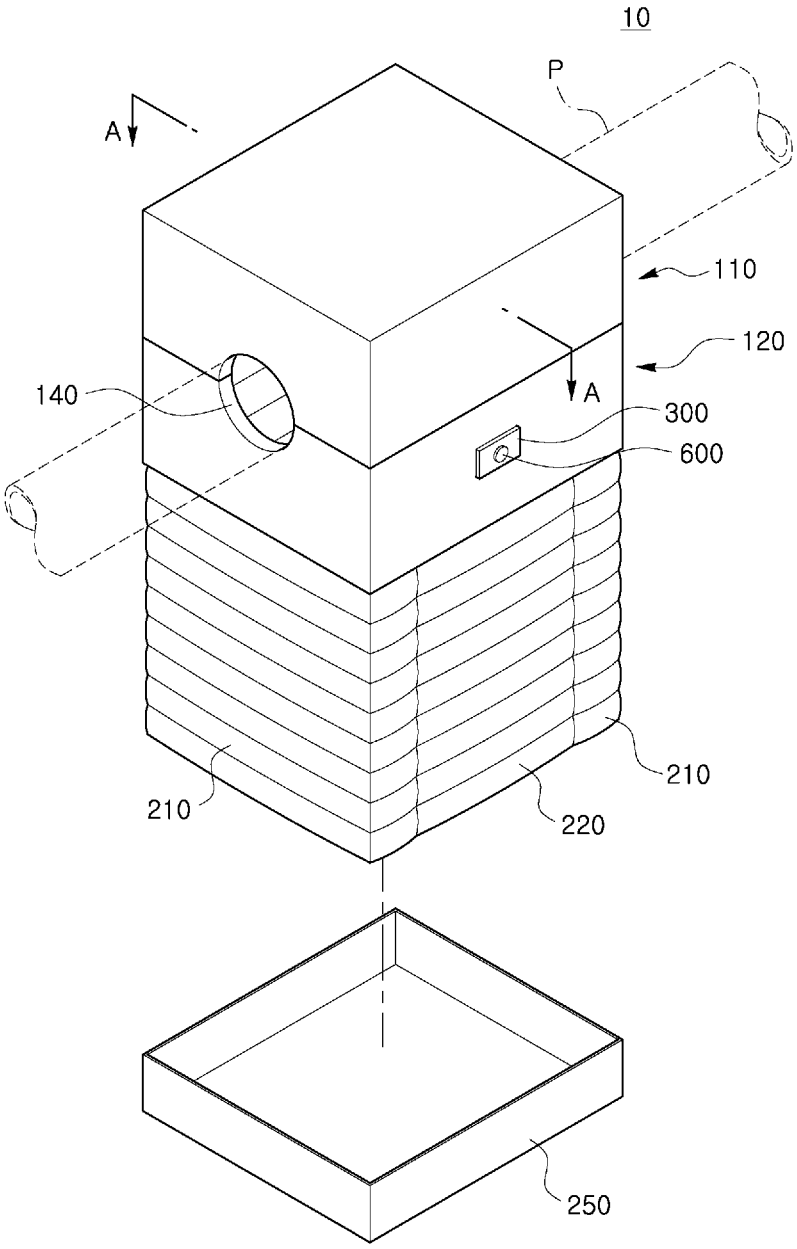
FIG. 2A is a view showing a state after the fluid collecting apparatus of FIG. 1A is operated.
Figure 2B:
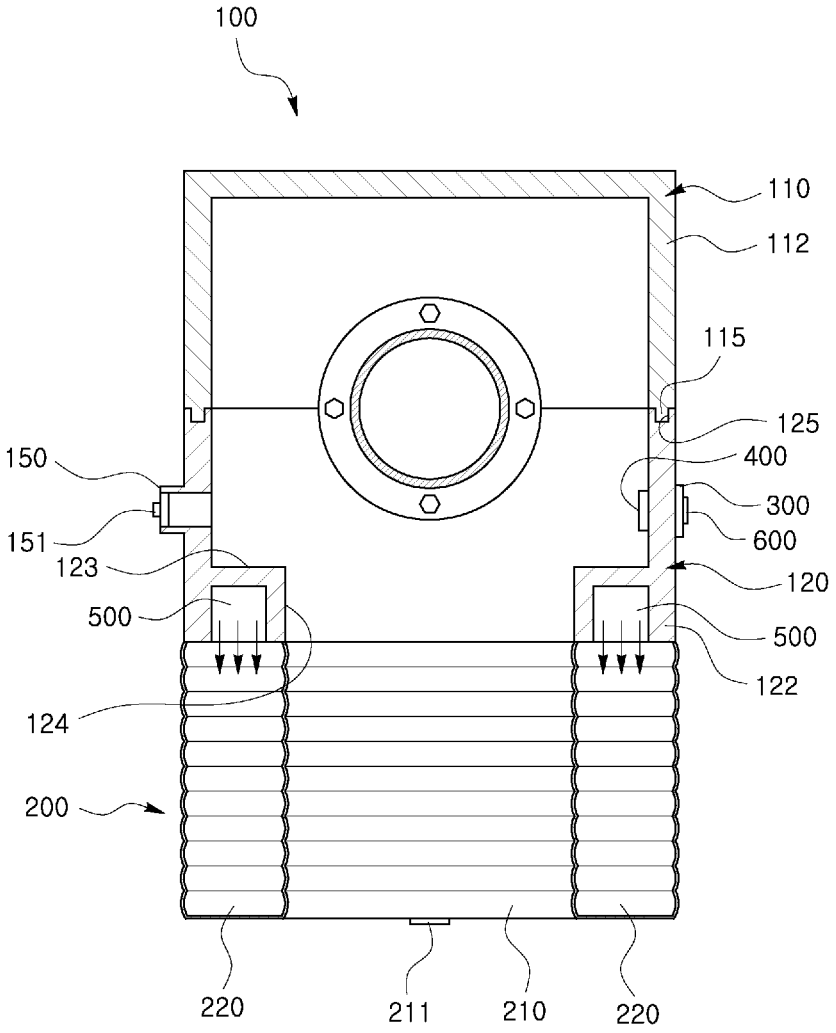
FIG. 2B is a sectional view taken along line A-A of FIG. 2A.

FIG. 2A is a view showing a state after the fluid collecting apparatus of FIG. 1A is operated, and FIG. 2B is a sectional view taken along line A-A of FIG. 2A.

Referring to FIGS. 2A and 2B, if the fluid detector 400 detects the leakage of the fluid, the detection signal is transmitted to the controller 300, and the controller 300 transmits the control signal to the auxiliary-bag propeller 500. The auxiliary-bag propeller 500 receiving the control signal may provide the propulsive pressure to the auxiliary bag 220, thus expanding the auxiliary bag 220. By the expansion of the auxiliary bag 220, the collecting bag 210 connected to the auxiliary bag 220 may be simultaneously expanded. As both the auxiliary bag 220 and the collecting bag 210 are expanded in this way, the protective cover 250 may be separated from the body 100 or be ruptured. The auxiliary bag 220 and the collecting bag 210 may be exposed to the outside with being expanded. The fluid escaping from the pipe P may be moved into and collected in the expanded interior space of the collecting bag 210 that is connected to the interior space of the body 100. The length and volume to which the collecting bag 210 is expanded may be variously set in consideration of the kind and nature of the leaked fluid. The collecting bag may be formed to have greater expansion length and expansion volume as compared to those illustrated in the drawings.

A fluid recovery device (not shown) may be connected to the fluid outlet 150 formed in the second sidewall 122 of the body 100 or to the fluid outlet 211 formed in the lower end of the collecting bag 210, thus safely collecting and recovering the continuously leaked fluid.

Figure 3A:
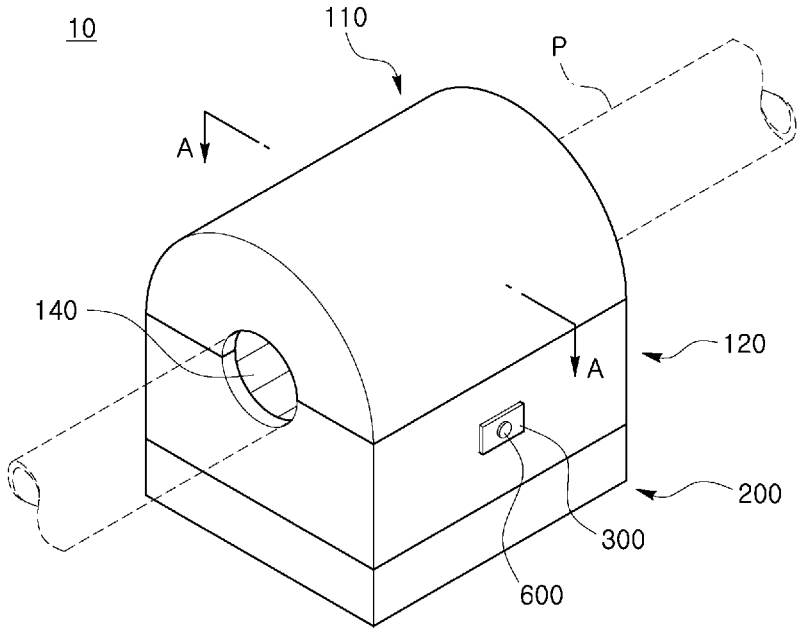
FIG. 3A is a perspective view showing a fluid collecting apparatus according to another embodiment of the present invention.
Figure 3B:
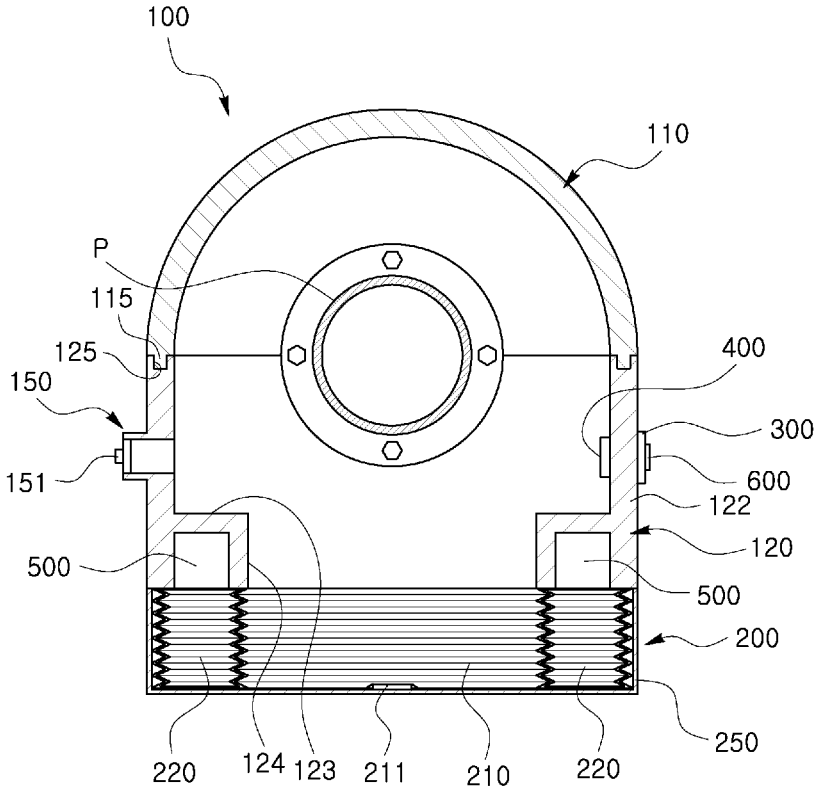
FIG. 3B is a sectional view taken along line A-A of FIG. 3A.

FIG. 3A is a perspective view showing a fluid collecting apparatus according to another embodiment of the present invention, and FIG. 3B is a sectional view taken along line A-A of FIG. 3A. The duplicated description will be omitted and components different from those of the preceding embodiment will be mainly described herein.

Referring to FIGS. 3A and 3B, the first body portion 110 may be formed in a semi-cylindrical shape. Thereby, the fluid leaked from the pipe P may be smoothly and effectively conveyed along the inner curved surface of the first body portion 110 to the collecting bag 210 and then collected in the collecting bag 210.

Figure 4A:
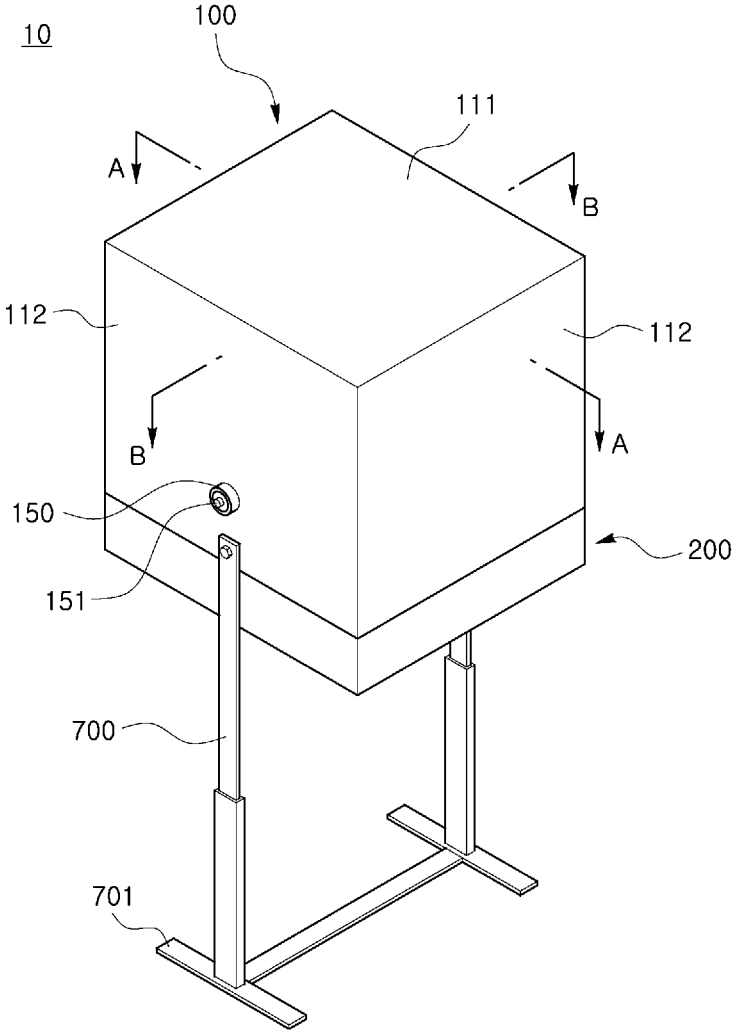
FIG. 4A is a perspective view showing a fluid collecting apparatus according to a further embodiment of the present invention.
Figure 4B:
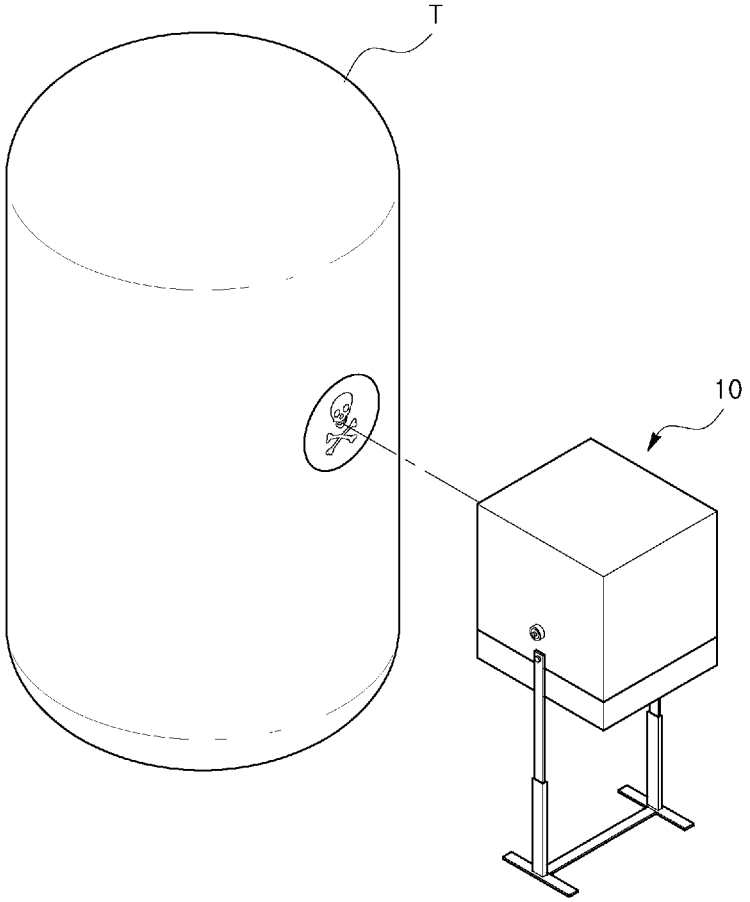
FIG. 4B is a view showing a state where the fluid collecting apparatus of FIG. 4A is installed in an area of a fluid storage tank from which fluid may potentially leak.
Figure 4C:
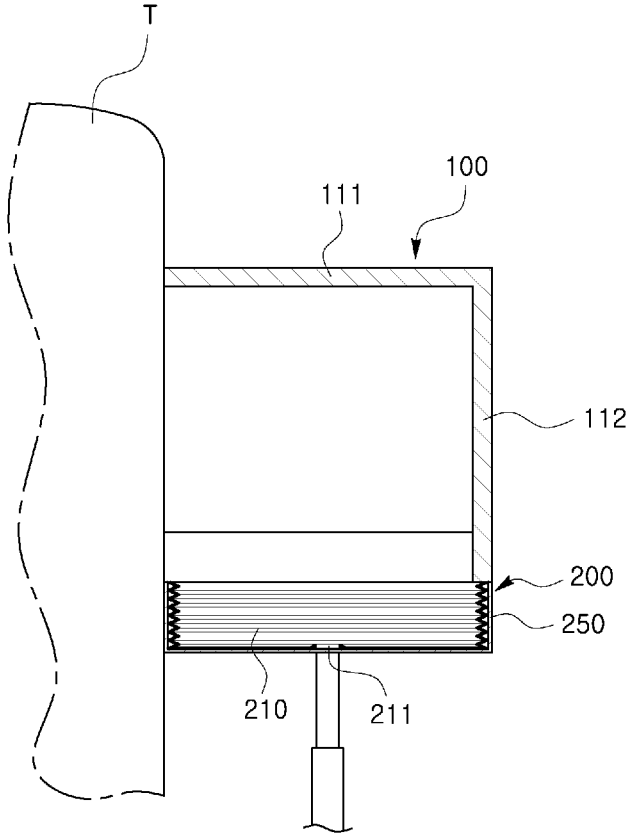
FIG. 4C is a sectional view taken along line A-A of FIG. 4A.
Figure 4D:
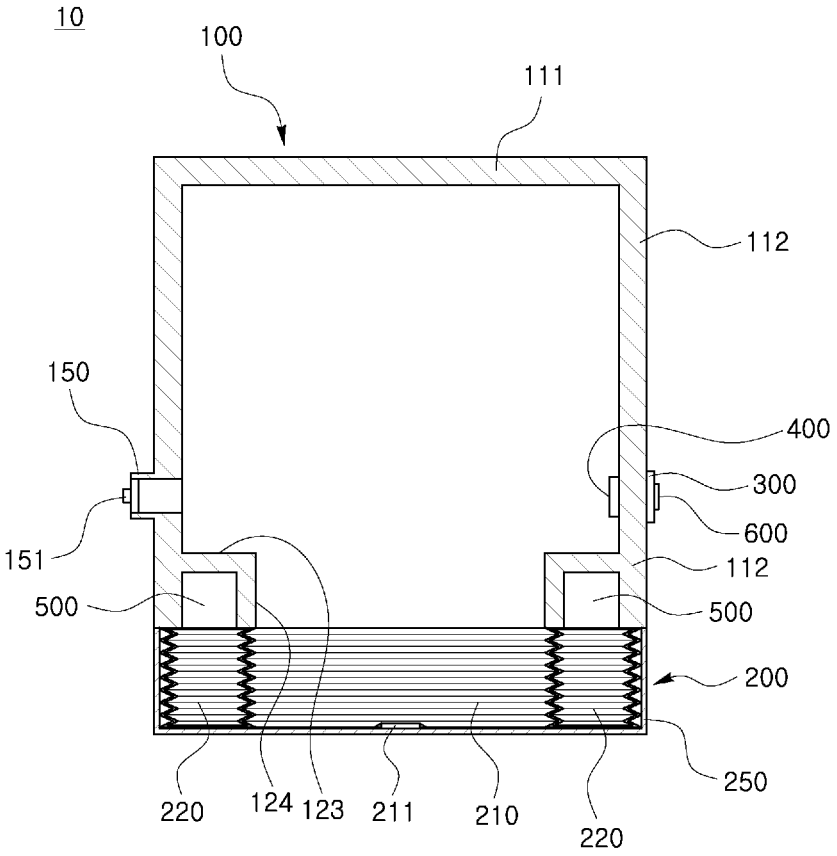
FIG. 4D is a sectional view taken along line B-B of FIG. 4A.

FIG. 4A is a perspective view showing a fluid collecting apparatus according to a further embodiment of the present invention, FIG. 4B is a view showing a state where the fluid collecting apparatus of FIG. 4A is installed in an area of a fluid storage tank from which fluid may potentially leak, FIG. 4C is a sectional view taken along line A-A of FIG. 4A, and FIG. 4D is a sectional view taken along line B-B of FIG. 4A. The duplicated description will be omitted and components different from those of the preceding embodiment will be mainly described herein.

Referring to FIGS. 4A to 4D, the fluid collecting apparatus 10 may have the shape of a box that is open at one surface thereof. The open surface may cover the area of a fluid storage tank T from which fluid may potentially leak, the fluid storage tank T storing the fluid, such as toxic gas or strong-acid gas.

The body 100 of the fluid collecting apparatus 10 may include a rectangular plate 111, three sidewalls 112 extending downwards from edges of the plate 111, a first inner wall 123, and a second inner wall 124. The first inner wall 123 may be formed to extend from the inner surface of the sidewall 112 contacting the fluid storage tank towards the interior space of the body 100. The second inner wall 124 may be formed to extend downwards from an end of the first inner wall 123 in such a way as to be parallel to the sidewall 112. According to this embodiment, two first inner walls 123 and two second inner walls 124 are provided. However, unlike this embodiment, only one first inner wall 123 and only one second inner wall 124 may be provided.

In order to prevent the fluid escaping from the fluid storage tank T from leaking through a gap between the wall surface of the fluid storage tank T and the sidewall 112, the gap may be sealed by Teflon, silicone or the like.

The fluid collecting apparatus 10 may be supported by a support member 700 connected to the sidewall 112 of the body 100. Since the support member 700 is adjustable in height, the fluid collecting apparatus 10 may be installed at a desired height. The support member 700 may be stably locked to the ground by a locking member 701.

Figure 5A:
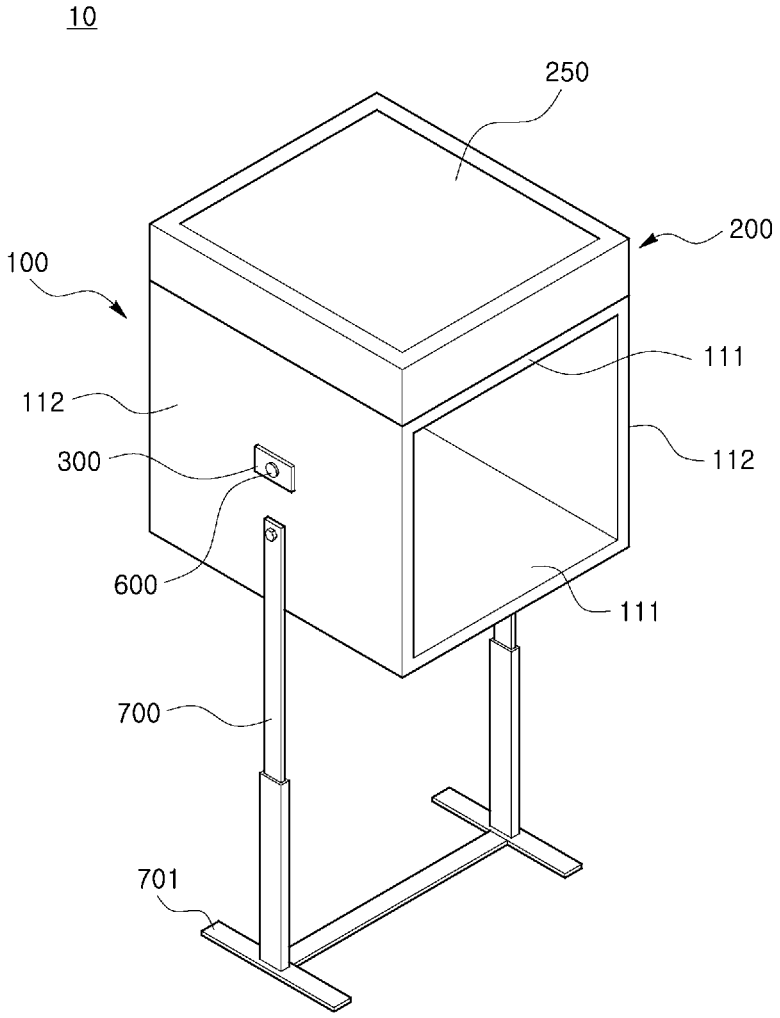
FIG. 5A is a perspective view showing a fluid collecting apparatus according to yet another embodiment of the present invention.
Figure 5B:
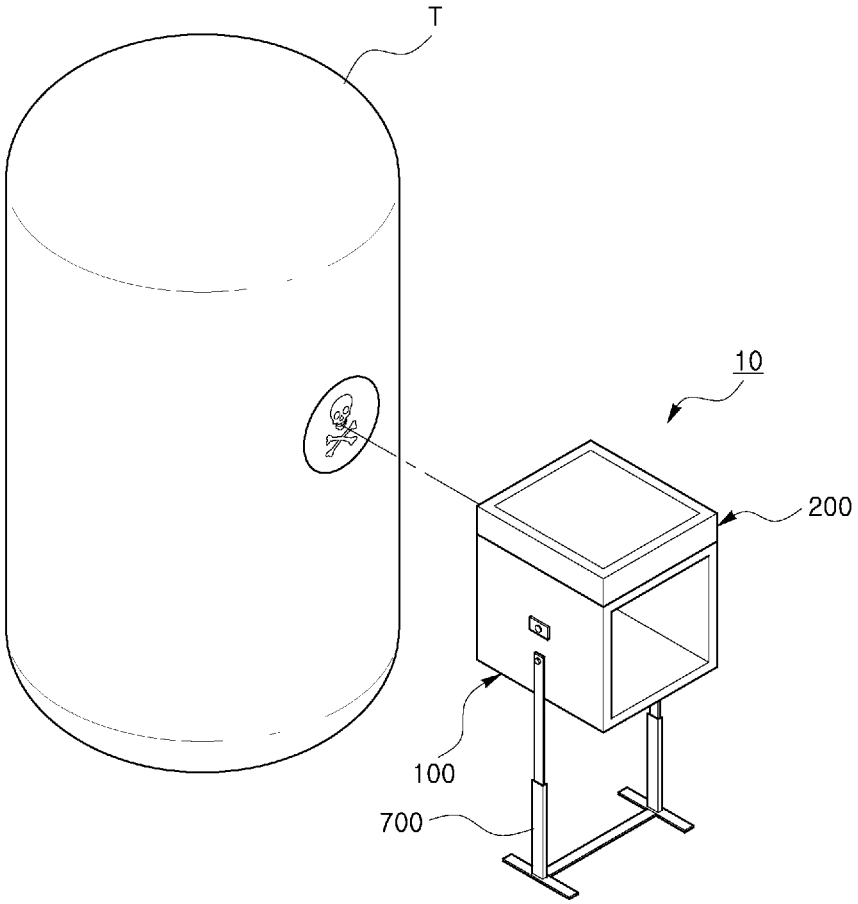
FIG. 5B is a view showing a state where the fluid collecting apparatus of FIG. 5A is installed in an area of a fluid storage tank from which fluid may potentially leak.
Figure 5C:
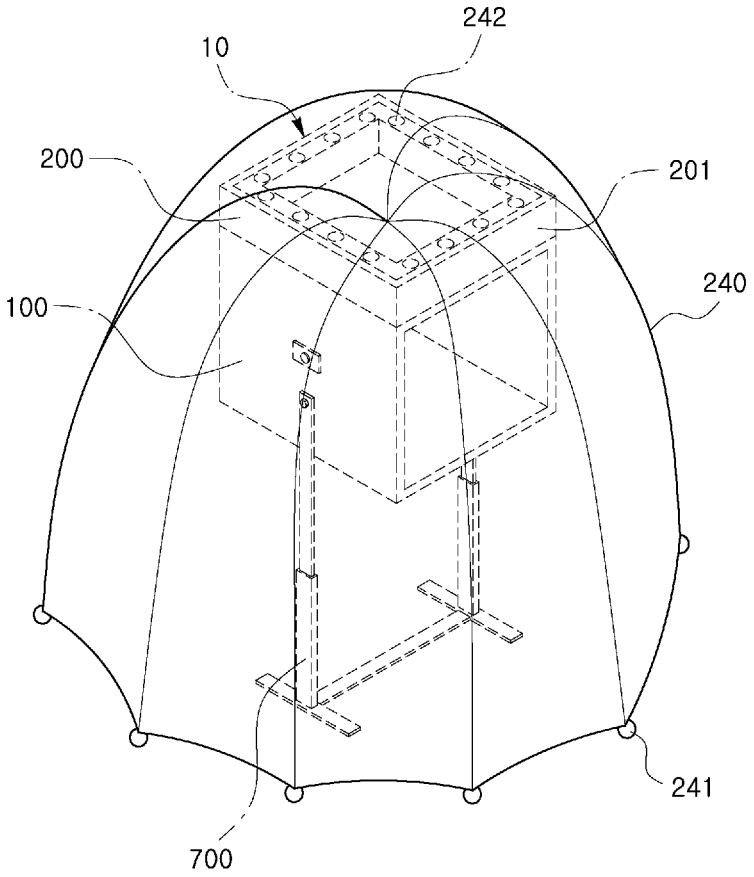
FIG. 5C is a view showing a state after the fluid collecting apparatus of FIG. 5A is operated.

FIG. 5A is a perspective view showing a fluid collecting apparatus according to yet another embodiment of the present invention, FIG. 5B is a view showing a state where the fluid collecting apparatus of FIG. 5A is installed in an area of a fluid storage tank from which fluid may potentially leak, and FIG. 5C is a view showing a state after the fluid collecting apparatus of FIG. 5A is operated. The duplicated description will be omitted and components different from those of the preceding embodiment will be mainly described herein.

Referring to FIGS. 5A to 5C, the fluid collecting apparatus 10 may include a body 100, a collector 200, and a controller 300.

The body 100 has the shape of a box that is penetrated at a central portion thereof. The body 100 may include two facing plates 111, and two sidewalls 112 connecting edges of the two plates 111 to each other.

The collector 200 is disposed above the body 100, and may include a collector sidewall 201, a collecting screen 240, a plurality of collecting-screen support weights 241 connected to an end of the collecting screen 240, and a protective cover 250 covering the collecting screen 240. The collector sidewall 201 may be located above the edge of the rectangular plate 111 that is situated under the collector 200. The collector sidewall 201 may have a plurality of collecting-screen support weight-supporting holes 242 that are formed along the upper surface thereof. The collecting screen 240 may be disposed in a space defined by the rectangular plate 111 situated under the collector 200 and the collector sidewall 201 in such a way as to be folded. Each collecting-screen support weight 241 may be located in the corresponding collecting-screen support weight-supporting hole 242.

The collector sidewall 201 may have a collecting-screen support weight propeller (not shown) that is located in the interior space thereof. The collecting-screen support weight propeller may receive the control signal from the controller 300 and then provide propulsive pressure to the collecting-screen support weight-supporting hole 242. The collecting-screen support weight propeller may be configured as a device including igniting powder that is ignited in response to the control signal (electric signal) of the controller 300 and propelling charge that is exploded by the ignition of the igniting powder to provide the propulsive pressure to the collecting-screen support weight-supporting hole 242. Alternatively, the collecting-screen support weight propeller may be configured as a device that stores compressed gas and sends the compressed gas to the collecting-screen support weight-supporting hole 242 in response to the control signal of the controller 300, thus providing the propulsive pressure.

If the fluid is leaked from the fluid storage tank T to the central portion of the body 100 and then is detected, the propulsive pressure is provided to the collecting-screen support weight-supporting hole 242 in response to the control signal of the controller 300, so that the collecting-screen support weight 241 flies up and falls to the ground of the peripheral area of the fluid storage tank T. As the collecting-screen support weight 241 flies up, the protective cover 250 is separated from the body 100 or ruptured to be removed therefrom. The collecting screen 240 is spread, thus surrounding the peripheral area of the fluid collecting apparatus 10. The leaked fluid may be confined and collected in the collecting screen 240.

The fluid collecting apparatus 10 may further include a collecting-screen support weight actuating switch 600. The collecting-screen support weight actuating switch 600 may be provided on the controller 300. If the fluid leaked from the fluid storage tank T is detected and the collecting-screen support weight actuating switch 600 is pressed from an outside, the collecting-screen support weight actuating signal may be generated and transmitted to the controller 300. The controller 300 receiving the collecting-screen support weight actuating signal transmits the controls signal to the collecting-screen support weight propeller, thus causing the collecting-screen support weight 241 to be propelled and flied.

What is claimed is:

1. A fluid collecting apparatus, comprising:

a body disposed adjacent to fluid conveying or storing equipment to limit a moving path of fluid leaked from the equipment;

a collector connected to the body to collect the leaked fluid; and a controller connected to the body to control an operation of the collector, wherein the body has a first interior space surrounding an area of the equipment from which the fluid may be potentially leaked, and the collector comprises a collecting bag having a second interior space that communicates with the first interior space, and disposed on the moving path of the leaked fluid and an auxiliary bag connected to the collecting bag and having a third interior space separated from the second interior space, wherein the fluid collecting apparatus further comprises an auxiliary-bag propeller disposed adjacent to the auxiliary bag, the auxiliary-bag propeller giving a propulsive pressure to the third interior space in response to a control signal of the controller, thus expanding the auxiliary bag, wherein the operation of the collector includes the collecting bag being expanded by expansion of the auxiliary bag.

2. The fluid collecting apparatus as set forth in claim 1, wherein the collecting bag comprises a fluid outlet to discharge the leaked fluid.

3. The fluid collecting apparatus as set forth in claim 1, further comprising:

a fluid detector disposed on the moving path of the leaked fluid in the body, thus detecting the leaked fluid, wherein the fluid detector detects the leaked fluid and then transmits a detection signal to the controller.

4. The fluid collecting apparatus as set forth in claim 1, further comprising:

a collector actuating switch disposed on an outer surface of the body, wherein, as the collector actuating switch is pressed down, a collector actuating signal is transmitted to the controller, and thereby the controller actuates the collector.

5. The fluid collecting apparatus as set forth in claim 1, wherein the body comprises a fluid outlet to discharge the leaked fluid to an outside.

6. The fluid collecting apparatus as set forth in claim 1, wherein the controller communicates wirelessly with an exterior remote control room.

7. A fluid collecting apparatus, comprising:

a body disposed adjacent to fluid conveying or storing equipment to limit a moving path of fluid leaked from the equipment;

a collector connected to the body to collect the leaked fluid; and a controller connected to the body to control an operation of the collector, wherein the collector comprises a collecting screen disposed above the body and a plurality of collecting-screen support weights connected to an end of the collecting screen, wherein each of the collecting-screen support weights is flied up in response to the control signal of the controller, thus causing the collecting screen to surround a peripheral area of the body.

* * * * *